US006240997B1

(12) United States Patent
Lee

(10) Patent No.: US 6,240,997 B1
(45) Date of Patent: Jun. 5, 2001

(54) ROLLING STEEL DOOR

(76) Inventor: Ming-Kun Lee, 2/F., No. 13, Hsingnan St., Nankang Dist., Taipei City (TW)

( * ) Notice: Subject to any disclaimer, the term of this patent is extended or adjusted under 35 U.S.C. 154(b) by 0 days.

(21) Appl. No.: 09/440,664

(22) Filed: Nov. 16, 1999

(51) Int. Cl.[7] ..... E06B 9/08

(52) U.S. Cl. ..... 160/133; 160/271; 160/310; 74/356; 16/95 R; 198/803.12

(58) Field of Search ..... 160/7, 201, 265, 160/271, 310, 133; 16/95 R, 96 R; 49/26, 27, 28; 74/356; 198/803.12

(56) References Cited

U.S. PATENT DOCUMENTS

| | | | | |
|---|---|---|---|---|
| Re. 28,746 | * | 3/1976 | Bruce | 59/78 |
| 1,985,828 | * | 12/1934 | Himmelmann | 160/133 |
| 2,095,690 | * | 10/1937 | Brunst | 160/133 |
| 2,167,875 | * | 8/1939 | Cornell et al. | 160/133 X |
| 2,245,079 | * | 6/1941 | Pejchar | 160/133 |
| 2,898,988 | * | 8/1959 | Zoll | 160/133 |
| 2,940,520 | * | 6/1960 | Cookson, Jr. et al. | 160/133 |
| 3,899,873 | * | 8/1975 | Fink | 16/95 R X |
| 4,050,750 | * | 9/1977 | Yoshihashi et al. | 74/356 X |
| 4,058,351 | * | 11/1977 | Murphy | 74/356 X |
| 4,083,611 | * | 4/1978 | Schaffner et al. | 74/356 X |
| 4,501,351 | * | 2/1985 | Tracy | 198/803.12 X |
| 4,590,758 | * | 5/1986 | Hannig et al. | 59/85 |
| 4,880,108 | * | 11/1989 | Burk | 198/803.12 |

* cited by examiner

*Primary Examiner*—Bruce A. Lev
(74) *Attorney, Agent, or Firm*—Rosenberg, Klein & Lee

(57) ABSTRACT

A rolling steel door, which includes a plurality of transverse rod members, a plurality of sleeves respectively sleeved onto the transverse rod members, a plurality of links respectively coupled to the transverse rod members to hold the transverse rod members in parallel, and a plurality of locating pins respectively fastened to the transverse rod members to stop the sleeves against the links, wherein the transverse rod members are hollow tubes; the links each comprise two coupling ends, two coupling holes respectively formed on the coupling ends and coupled to a respective transverse rod member, a reinforcing peripheral flange perpendicularly raised around the periphery thereof and the border of each coupling hole, and a neck on the middle.

7 Claims, 8 Drawing Sheets

ROLLING STEEL DOOR

BACKGROUND OF THE INVENTION

The present invention relates to a rolling steel door, and more particularly to a light structure of rolling steel door, which needs less storage space when rolled up.

FIGS. from 7 through 10 show a rolling steel door 2 according to the prior art. This structure of rolling steel door comprises a plurality of solid metal transverse rods 23, a plurality of sleeves 22 respectively sleeved onto the metal transverse rods 23, and a plurality of links 21 respectively coupled to the metal transverse rods 23 to hold the metal transverse rods in parallel. The links 21 are oblong metal plates, each comprising two remote ends 211, and two coupling holes 212 respectively formed on the two remote ends 211 and coupled to a respective metal transverse rod 23. The links 21 are arranged in sets. Each set of links 21 include two pairs of first links respectively coupled between two adjacent pairs of metal transverse rods, and one second link coupled between the adjacent metal transverse rods of the two adjacent pairs of metal transverse rods being connected to the pairs of first links and retained between the pairs of first links. This structure of rolling steel door is still not satisfactory in function. The drawbacks of this structure of rolling steel door is outlined hereinafter.

1. Because the links 21 are flat members, the contact area between each coupling hole 212 and the corresponding metal transverse rod 23 is limited, and the metal transverse rods 23 tend to be damaged by the coarse border area of each coupling hole 212. Because the metal transverse rods 23 tend to be damaged by the coarse border area of each coupling hole 212, the metal transverse rods 23 must have a solid structure.
2. Because the metal transverse rods 23 are solid metal rods, the manufacturing cost and total weight of the rolling steel door are high, and a high capacity of motor, which consumes much electric power, must be used to move the rolling steel door. In case of a power failure, much effort must be employed to take up the rolling steel door manually.
3. Because the links 21 are flat members, they tend to be forced to vibrate when moving taking up or letting off the rolling steel door, thereby causing a high noise level to be produced (see FIG. 9).
4. Because the links 21 are flat members, the rolled diameter D1 of the rolling steel door cannot be minimized when rolled up about a spooling structure 213, i.e., a spacious receiving chamber must be provided to receive the rolling steel door when the rolling steel door is rolled up.

SUMMARY OF THE INVENTION

The present invention has been accomplished to provide a rolling steel door, which eliminates the aforesaid drawbacks. According to one aspect of the present invention, the rolling steel door comprises a plurality of transverse tubes, a plurality of sleeves respectively sleeved onto the transverse tubes, a plurality of links respectively coupled to the transverse tubes to hold the transverse tubes in parallel, and a plurality of locating pins respectively fastened to the transverse tubes to stop the sleeves against the links, wherein the transverse rod members are hollow tubes; the links each comprise two coupling ends, two coupling holes respectively formed on the coupling ends and coupled to a respective transverse rod member. Because transverse tubes are used instead of solid rod members, the total weight of the rolling steel door is minimized, and a less capacity of motor can be used to move the rolling steel door efficiently. According to another aspect of the present invention, each link comprises a reinforcing peripheral flange perpendicularly raised around the periphery and the border of each coupling hole. The reinforcing peripheral flange greatly reinforce the structural strength of the link, and relatively increases the contact area between each coupling hole and the respective transverse tube, enabling the rolling steel door to be smoothly and stably moved. According to still another aspect of the present invention, each link has a neck on the middle. When the rolling steel door is rolled up, the coupling end at one end of one link is closely attached to the neck at another link, therefore the diameter of the rolled up rolling steel door is minimized, i.e., less storage space is needed to receive the rolling steel door when the rolling steel door is rolled up.

DETAILED DESCRIPTION OF THE PREFERRED EMBODIMENT

Figure 1:
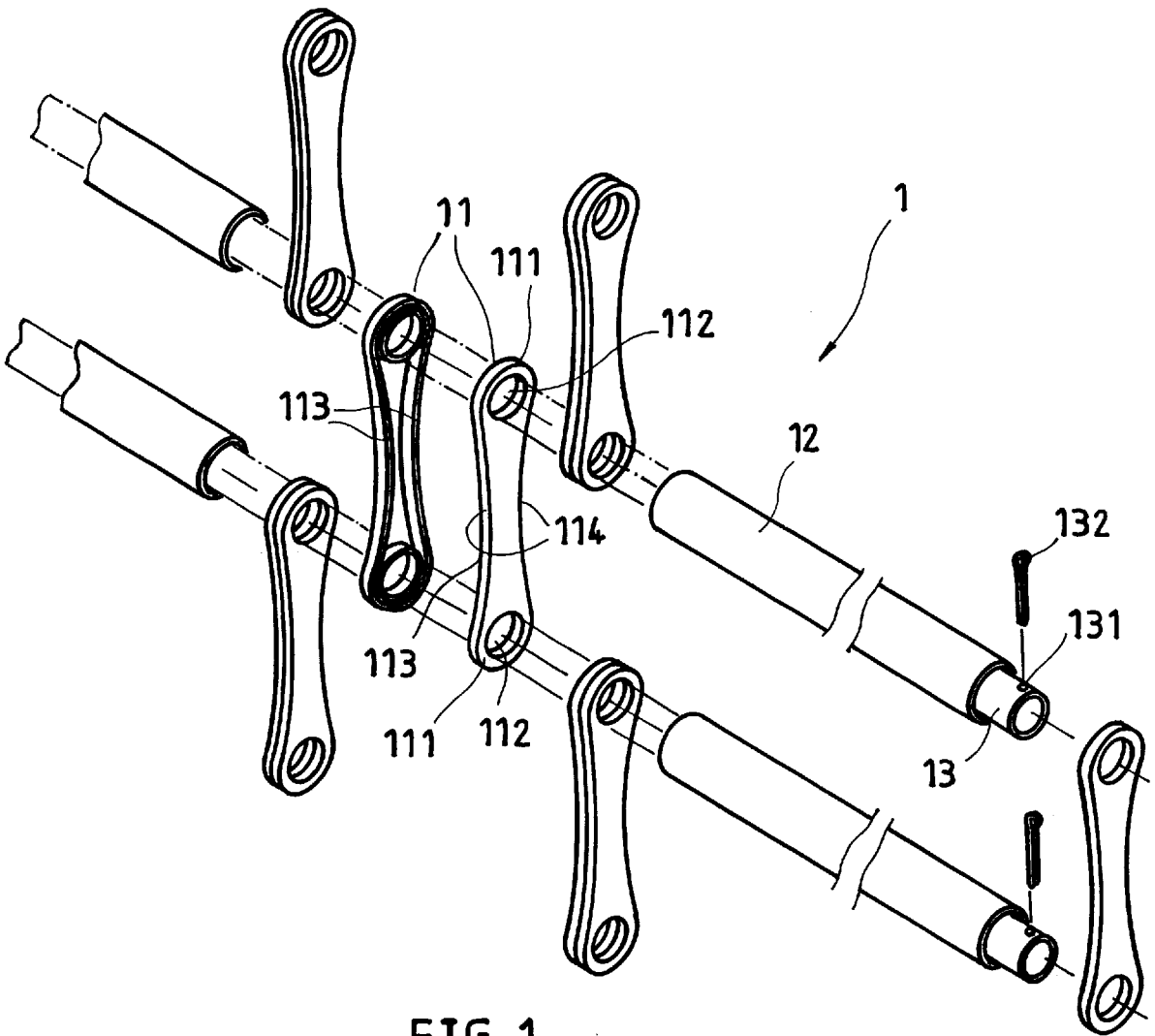
FIG. 1 is an exploded view of a part of a rolling steel door according to a first embodiment of the present invention.
Figure 2:
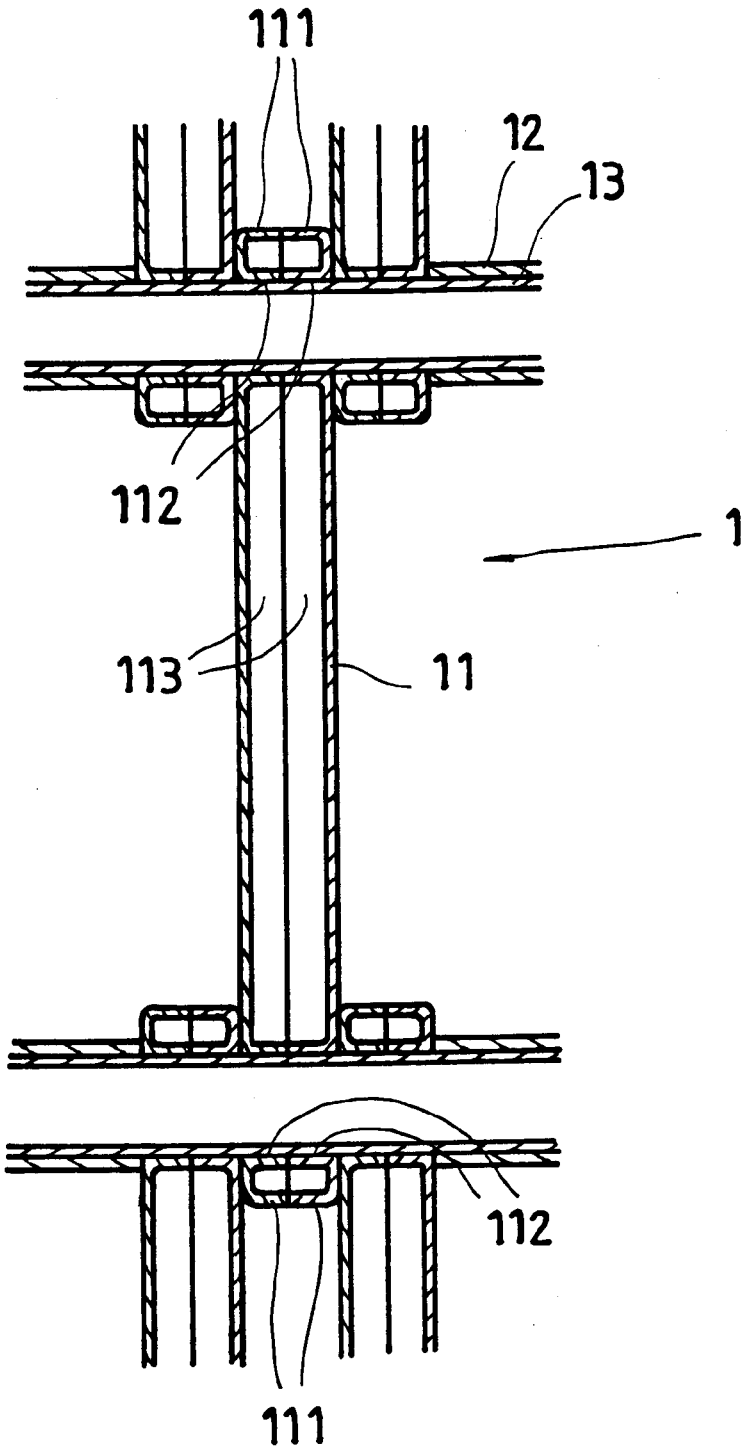
FIG. 2 is a sectional assembly view of FIG. 1.
Figure 3:
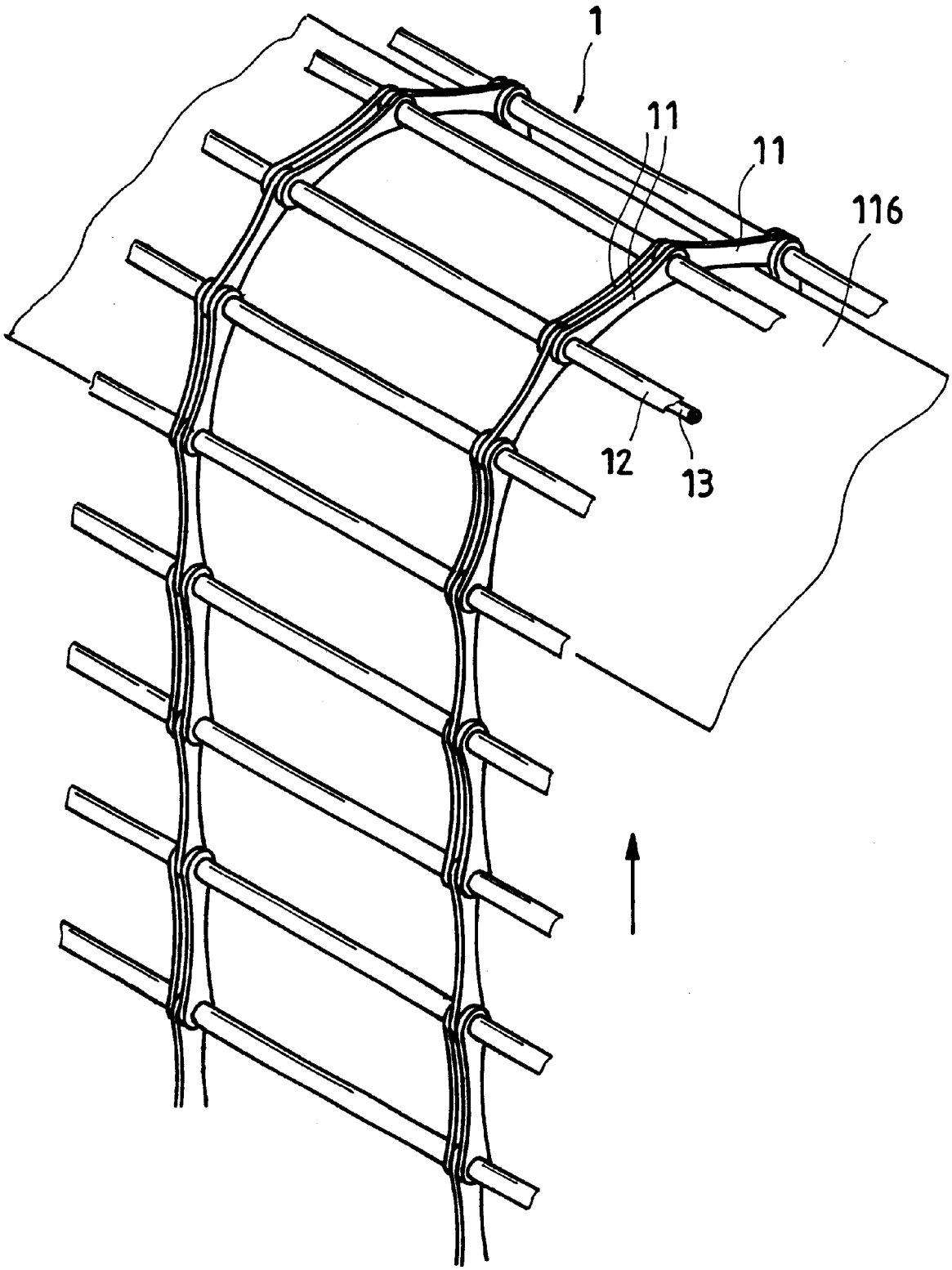
FIG. 3 is a perspective view of a part of the rolling steel door according to the first embodiment of the present invention.
Figure 4:
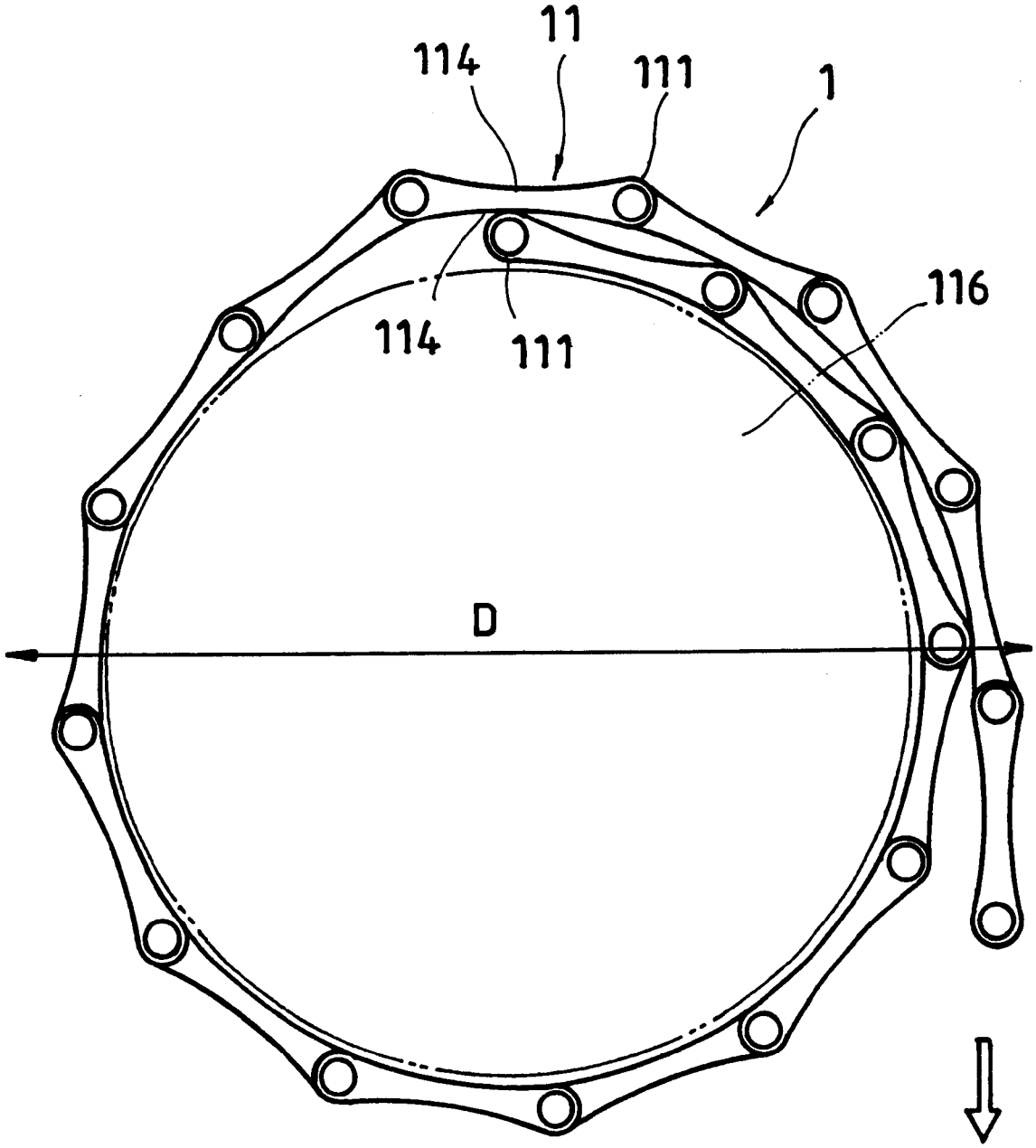
FIG. 4 is a side view of the first embodiment of the present invention, showing the rolling steel door rolled up.

Referring to FIGS. from 1 through 3, a rolling steel door 1 according to a first embodiment of the present invention is shown comprised of a plurality of transverse tubes 13, a plurality of sleeves 12 respectively sleeved onto the transverse tubes 13, a plurality of links 11 respectively coupled to the transverse tubes 13 to hold the transverse tubes 13 in parallel, and a plurality of locating pins 132 respectively fastened to pin holes 131 on the transverse tubes 13 to stop the sleeves 12 against the links 11. The links 11 are arranged in sets, each set including five pairs. The two links 11 of same pair are abutted against each other to form a link assembly. Each link 11 comprises two coupling ends 111, two coupling holes 112 respectively formed on the coupling ends 111 and coupled to a respective transverse tube 13, a reinforcing peripheral flange 113 perpendicularly raised around the periphery thereof and border area of each coupling hole 112, and a neck 114 on the middle. The five pairs of same set include two first pairs of links 11 respectively coupled between two adjacent pairs of transverse tubes 13, and one second pair of links 11 coupled between the adjacent transverse tubes 13 of the two adjacent pairs of transverse tubes 13 being connected to the first pairs of links 11 and retained between the two first pairs of links 11. Because the reinforcing peripheral flange 113 reinforces the structural strength of the respective link 11, the thickness of the links 11 can be minimized to diminish material cost. Because the transverse tubes 13 are not solid rod members, the total weight of the rolling steel door 1 is minimized. Therefore, a less capacity of motor, which consumes less electric power, is sufficient to move the rolling steel door 1. Further, because the reinforcing peripheral flange 113 has a part disposed around the border of each coupling hole 112, the contact area between one transverse tube 13 and one link 11 is relatively increased. Therefore, the rolling steel door 1 neither vibrates nor produces high noise when moved. Furthermore, when the rolling steel door 1 is rolled up, the coupling end 111 at one end of one link 11 is closely attached to the neck 114 at another link 11, therefore the rolled diameter D of the rolled up rolling steel door 1 is minimized, i.e., less storage space is needed to receive the rolling steel door 1 when the rolling steel door 1 is rolled up about a spooling structure 116.

Figure 6:
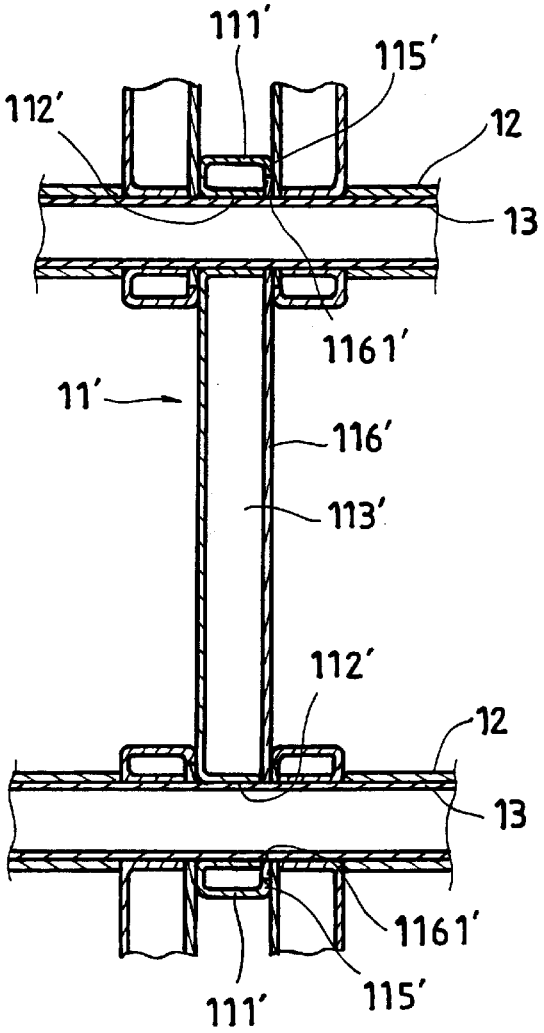
FIG. 6 is a sectional assembly view of a part of the rolling steel door according to the second embodiment of the present invention.
Figure 5:
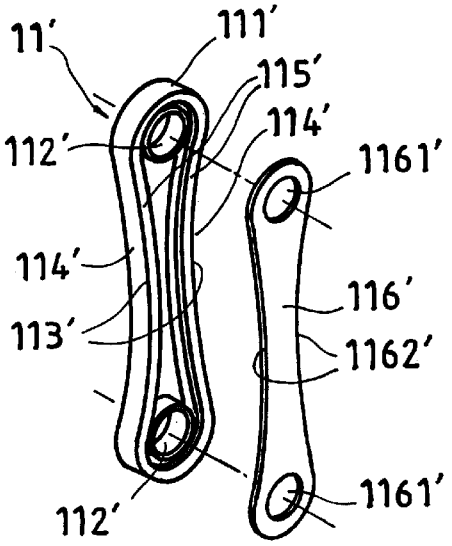
FIG. 5 is an exploded view of a link and a cover plate for a rolling steel door according to a second embodiment of the present invention.
Figure 7:
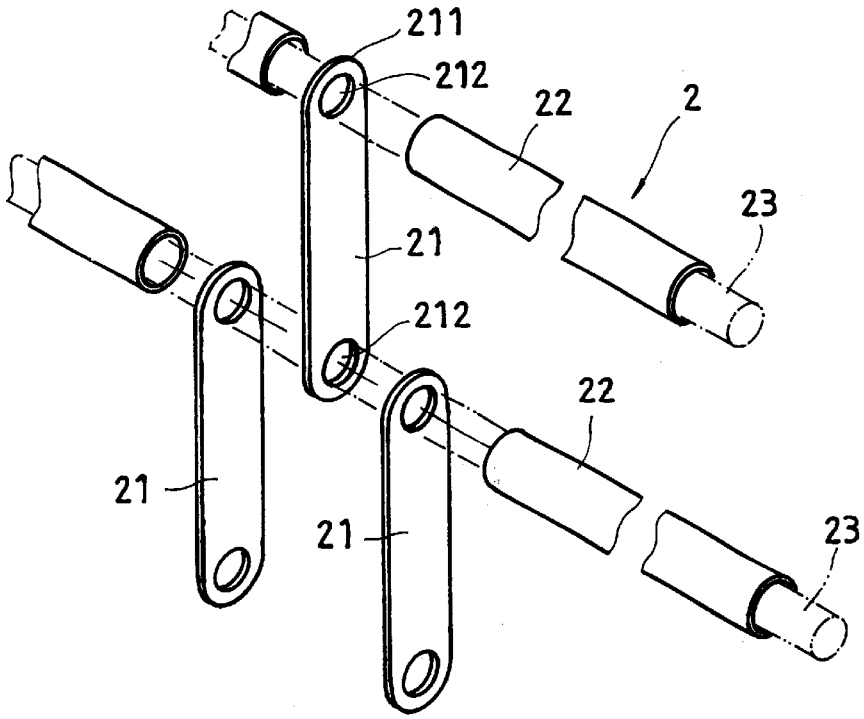
FIG.7 PRIOR ART
FIG. 7 is an exploded view of a part of a rolling steel door according to the prior art.
Figure 8:
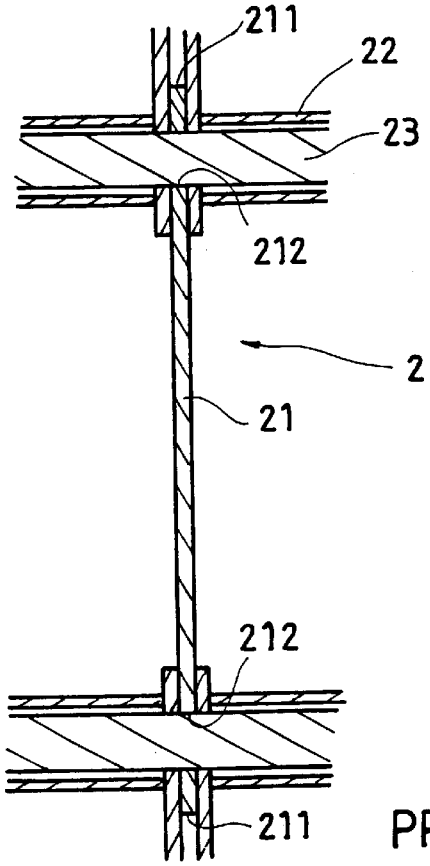
FIG.8 PRIOR ART
FIG. 8 is a sectional assembly view of a part of the prior art rolling steel door.
Figure 9:
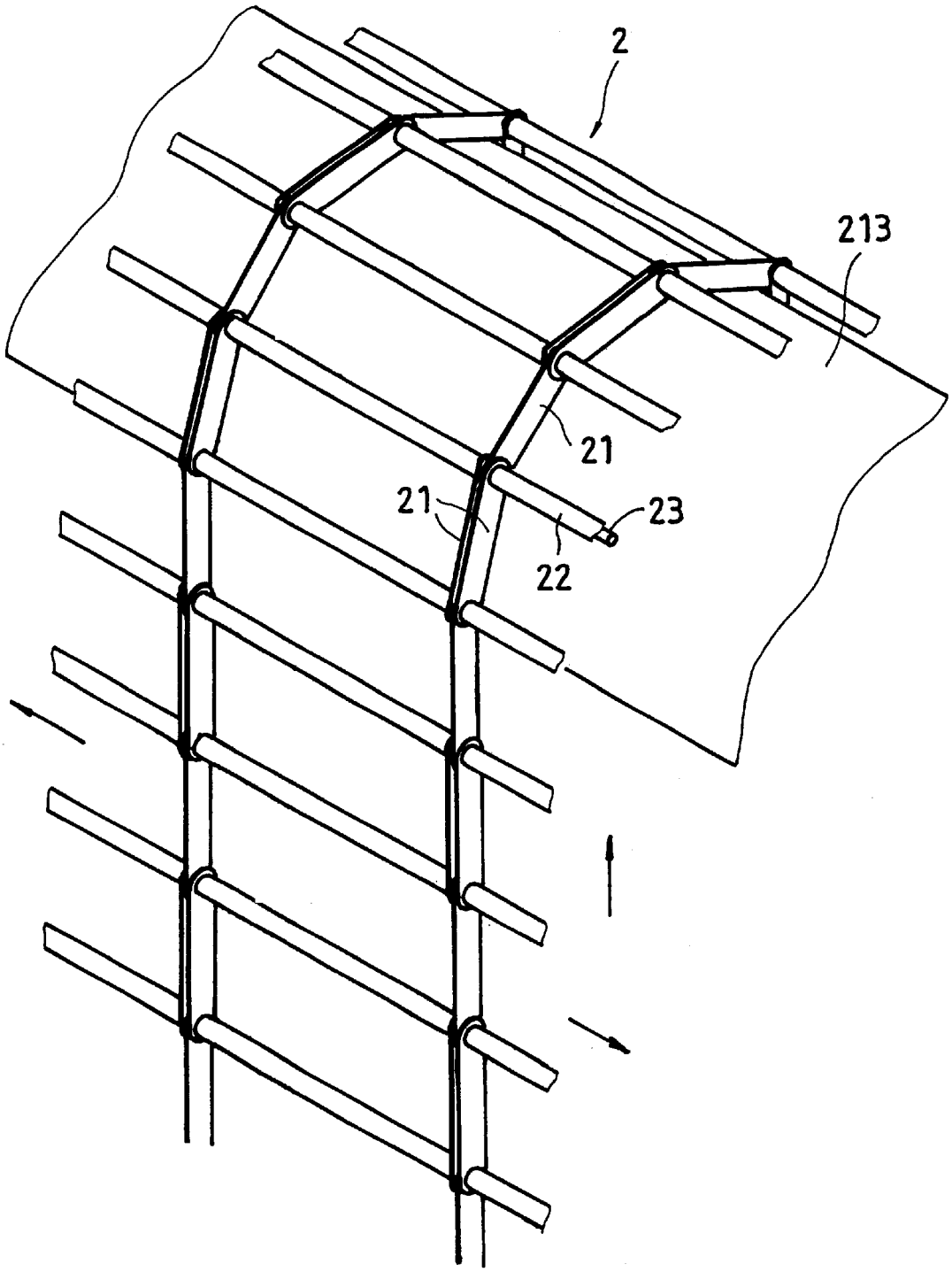
FIG. 9 PRIOR ART
FIG. 9 is a perspective view of a part of the prior art rolling steel door.
Figure 10:
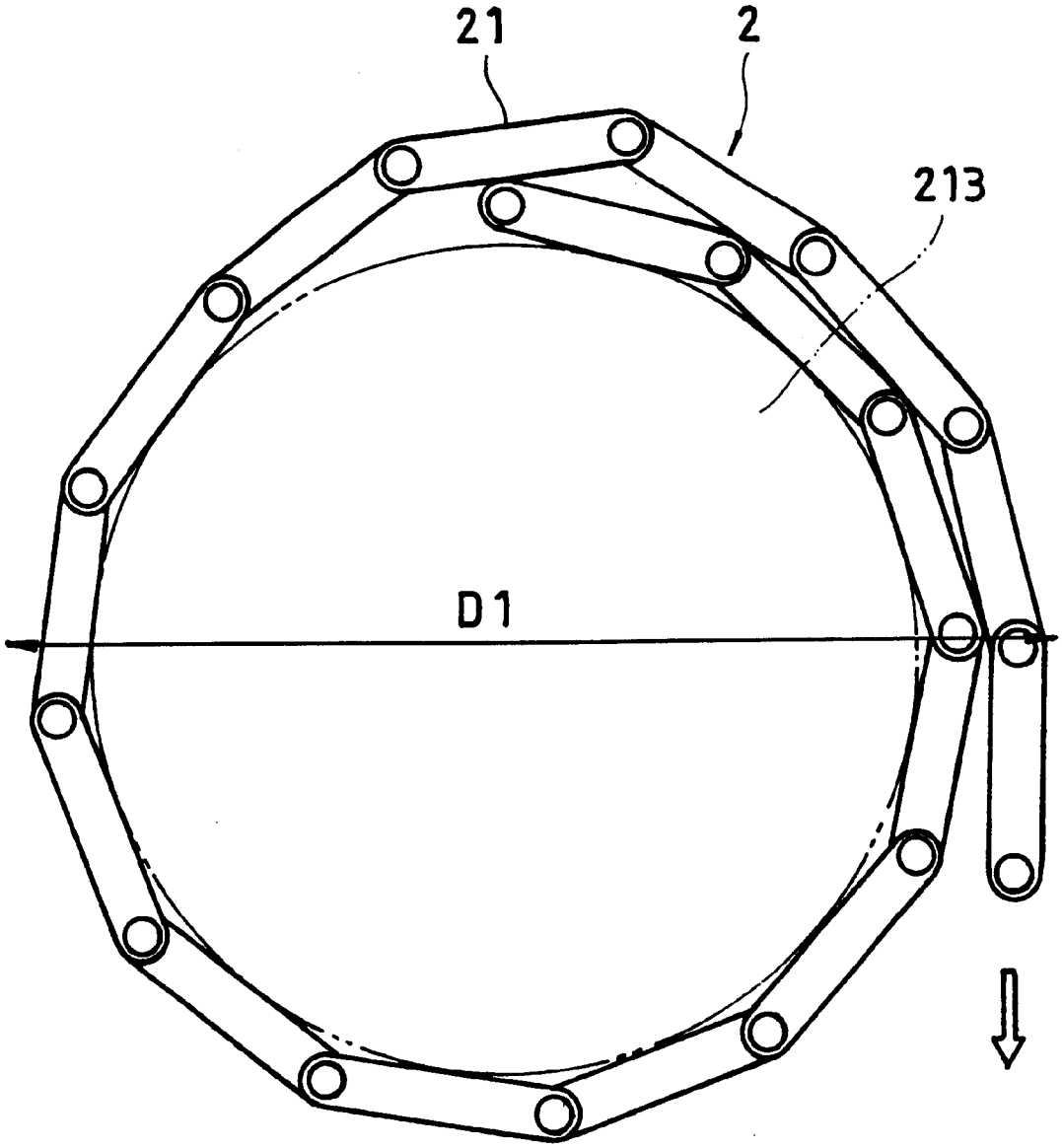
FIG. 10 PRIOR ART
FIG. 10 is a side view of the prior art rolling steel door when rolled up.

FIGS. 5 and 6 show an alternate form of the present invention. According to this alternate form, the links 11' are arranged in sets, each set including five links 11', each link 11' covered with a respective cover plate 116'. Each link 11' comprises two coupling ends 111', two coupling holes 112' respectively formed on the coupling ends 111' and coupled to a respective transverse tube 13, a reinforcing peripheral flange 113' perpendicularly raised around the periphery thereof, a top flange 115' perpendicularly inwardly extended from a remote side of the reinforcing peripheral flange 113', and a neck 114' on the middle. The five links 11' include two first links 11' respectively coupled between two adjacent pairs of transverse tubes 13, and one second link 11' coupled between the adjacent transverse tubes 13 of the two adjacent pairs of transverse tubes 13 being connected to the first links 11' and retained between the two first links 11'. Because the reinforcing peripheral flange 113' reinforces the structural strength of the respective link 11', the thickness of the links 11' can be minimized to diminish material cost. The cover plate 116' fits over the top flange 115' of the respective link 11', comprising two coupling holes 1161' on two distal ends thereof corresponding to the coupling holes 112' on the respective link 11', and a neck 1162' corresponding to the neck 114' of the respective link 11'. This alternate form achieves same effect as the aforesaid first embodiment of the present invention.

It is to be understood that the drawings are designed for purposes of illustration only, and are not intended as a definition of the limits and scope of the invention disclosed.

What the invention claimed is:

1. A rollable barrier comprising:

(a) a plurality of transverse rod members;

(b) a plurality of sleeve members coupled in substantially coaxial manner to each said transverse rod member, each said sleeve member having a substantially tubular contour;

(c) a plurality of links coupled to said transverse rod members for maintaining said transverse rod members substantially in a parallel relationship, each said link including a pair of opposed coupling end portions and a neck portion extending longitudinally therebetween, each said coupling end portion having formed therein a coupling hole, said coupling end and neck portions having a reinforcing peripheral flange portion extending laterally therefrom; and, (d) a plurality of locating pins respectively fastened to said transverse rod members for retentively engaging said sleeve members.

2. The rollable barrier as recited in claim 1 wherein each said link extends between an adjacent pair of said transverse rod members, each said coupling end portion of said link engaging one said transverse rod member.

3. The rollable barrier as recited in claim 2 wherein said neck portion of each said link defines a concave peripheral contour.

4. The rollable barrier as recited in claim 2, wherein said links are disposed in laterally coupled pairs to define a plurality of link assemblies having corresponding coupling end and neck parts.

5. The rollable barrier as recited in claim 4 comprising first and second sets of said link assemblies, wherein at least one said coupling end part of each said first set link assembly is sandwiched laterally by respective ones of said coupling end parts of at least a pair of said second set link assemblies for common engagement of one said transverse rod member.

6. The rollable barrier as recited in claim 2 further comprising a plurality of cover plates for respectively engaging said reinforcing peripheral flange portions of a plurality of said links, each said cover plate having formed therein a pair of holes respectively disposed in substantial alignment with said coupling holes of one said link.

7. A rollable barrier comprising:

(a) a plurality of transverse rod members;

(b) a plurality of sleeve members coupled in substantially coaxial manner to each said transverse rod member, each said sleeve member having a substantially tubular contour;

(c) a plurality of links coupled to said transverse rod members for maintaining said transverse rod members substantially in a parallel relationship, each said link including a pair of opposed coupling end portions and a neck portion extending longitudinally therebetween, each said coupling end portion having formed therein a coupling hole, said coupling end and neck portions having a reinforcing peripheral flange portion extending laterally therefrom, said peripheral flange portion defining a top flange; and, (d) at least one cover plate coupled to and laterally covering one said link, said cover plate engaging said top flange of one said link and having formed therein a pair of holes respectively disposed in substantial alignment with said coupling holes of said link; and, (e) a plurality of locating pins respectively fastened to said transverse rod members for retentively engaging said sleeve members.

* * * * *